US006561364B1

(12) United States Patent
Brunsden

(10) Patent No.: US 6,561,364 B1
(45) Date of Patent: May 13, 2003

(54) PORTABLE SHELF FOR MOUNTING ON A TOWEL BAR

(76) Inventor: Edwin B. Brunsden, 3126 Chari Dr., Flint, MI (US) 48507

( * ) Notice: Subject to any disclaimer, the term of this patent is extended or adjusted under 35 U.S.C. 154(b) by 658 days.

(21) Appl. No.: 09/002,650

(22) Filed: Jan. 5, 1998

(51) Int. Cl.[7] ..... A47F 5/08

(52) U.S. Cl. ..... 211/90.01; 211/86.01; 211/88.04; 248/214

(58) Field of Search ..... 211/90.01, 105.1, 211/86.01, 88.04; 248/50, 214; 108/42, 47, 152, 29

(56) References Cited

U.S. PATENT DOCUMENTS

| | | | | | |
|---|---|---|---|---|---|
| 913,228 | A | * | 2/1909 | McCarthy | 211/90.01 X |
| 1,924,074 | A | * | 8/1933 | O'Halloran | 211/86.01 X |
| 2,612,273 | A | * | 9/1952 | Smith | 211/86.01 |
| 2,944,674 | A | * | 7/1960 | Fau | 211/90.01 X |
| 4,233,911 | A | * | 11/1980 | Vignale | 211/86.01 X |
| 4,372,449 | A | * | 2/1983 | Fink | 211/86.01 |
| 4,827,849 | A | * | 5/1989 | Vignale | 211/86.01 X |
| 4,870,907 | A | * | 10/1989 | McKee | 108/42 |
| 5,169,010 | A | * | 12/1992 | Fortner | 211/86.01 |
| 5,253,837 | A | * | 10/1993 | Loux | 211/90.01 X |
| 5,351,842 | A | * | 10/1994 | Remmers | 211/90.01 |
| 5,433,152 | A | * | 7/1995 | Henry | 211/90.01 X |
| 5,706,737 | A | * | 1/1998 | Whitehead et al. | 211/86.01 X |
| 5,711,434 | A | * | 1/1998 | Adams | 211/86.01 |
| 5,722,329 | A | * | 3/1998 | Weng | 108/42 |

* cited by examiner

*Primary Examiner*—Daniel P. Stodola
*Assistant Examiner*—Khoa Tran
(74) *Attorney, Agent, or Firm*—James C. McLaughlin

(57) ABSTRACT

A portable shelf for mounting on an existing, conventional, wall affixed towel bar using only friction and gravitationally induced forces. The shelf is capable of holding sundry articles customarily found in a bathroom while also providing a bar that may be used to hold towels. The shelf is preferably formed from two brackets pierced by multiple rods preferably of uniform cross-section. More than two brackets may be used resulting in a shelf that has enhanced stiffness. The brackets have a side appearance resembling the capital Greek letter gamma with a vertical back that conforms to the wall, a top that is pierced by multiple rods lying in a horizontal plane, a bottom pierced by at least one rod that is spaced from the wall, and a front that extends downward from a point in front of the towel bar to a point that is behind the towel bar and closer to the wall. The shelf's width may be adjusted by sliding the brackets on the rods. The shelf is mounted by looping its bottom over the towel bar and lowering the shelf onto the towel bar.

19 Claims, 3 Drawing Sheets

PORTABLE SHELF FOR MOUNTING ON A TOWEL BAR

TECHNICAL FIELD OF THE INVENTION

The technical field of the present invention is that of articles that can be securely coupled to an existing conventional, wall-mounted, horizontal towel bar using only friction and gravitationally induced forces (i.e., fasteners such as nails, screws, or adhesives are not used). More particularly, the technical field of the present invention is of such articles that are portable shelves capable of holding sundry articles customarily found in a bathroom such as shampoo bottles and bars of soap while also providing a bar that may be used to hold towels.

BACKGROUND INFORMATION

A desire for an auxiliary shelf and towel bar has long existed. U.S. Pat. No. 4,181,382 shows a cabinet consisting of two solid shelves that are each longer than the distance between the associated conventional towel bar's brackets and shelves that extend well forward of the associated conventional towel bar. The top shelf is connected to the associated conventional towel bar by spring-like numeral-seven-shaped brackets of undulating form with alternating projections and towel-rack-rod fitting recesses that are secured at one end only to the underside of the top shelf. An auxiliary towel rod is secured to the forward part of the top shelf. This is a relatively heavy appliance with a significant part of its mass (and the auxiliary towel rod) well forward of the flexible attachment to the conventional towel bar. The burden on the conventional towel rod is expected to be significant and the forces of objects on the forward part of the shelf, which includes any towels on the auxiliary towel rod, will produce a moment that will tend to dismount the cabinet. The large size of the shelves and their solid nature encourages overloading the shelves and exacerbating the expected significant static load on the conventional towel bar. The present invention includes among its objectives having a minimal mass, a single open frame shelf usually shorter than the distance between the associated conventional towel bar's brackets that does not entice overloading, and an attachment scheme and loading moments that tend to aid attachment to its associated conventional towel bar.

U.S. Pat. No. 4,799,432 shows three solid, fixed shelves placed above the associated conventional towel bar. The use of solid shelves encourages overloading and the placement of all of the loads above, and distant from, the pivot with the associated conventional towel bar tends to reduce the stability of the assembly. The use of a fixed width precludes adjustment to accommodate different spacings of the brackets of the associated conventional towel bracket. The present invention includes among its objectives having a minimal mass, a single open frame shelf close to the associated conventional towel bar that does not entice overloading, and a scheme allowing easy adjustment of the width by the user without the need for tools.

A set of U.S. patents to Vignale (including U.S. Pat. Nos. D299,894 and 4,827,849) shows a single fixed, solid shelf supported on, and above, its associated conventional towel bar that allows use of the associated conventional towel bar. Most of the wall touching surface is above the pivot point on the conventional towel bar, and all of the load bearing surface is above the pivot point, compromising stability. The shelf may contain a front raised peripheral rim that will tend to be struck by an object being removed from the shelf creating a significant overturning moment. In addition to the aforementioned relevant objectives of the present invention that include an open frame shelf and easy width adjustment, the present invention also has an objective of placing the majority of the wall touching surface, and some of the load, below the associated conventional towel bar so as to enhance stability.

Additional objects of the present invention will be apparent from the descriptions and claims presented hereafter.

SUMMARY OF THE INVENTION

The present invention is a light weight, portable shelf that is intended to be mounting on an existing, conventional, wall affixed towel bar using only friction and gravitationally induced forces. When so mounted, the shelf occludes the conventional towel bar and is capable of holding sundry articles customarily found in a bathroom while also providing at least one bar that may be used to hold towels. The preferred embodiment of the shelf further provides a hook that may be used to hold objects such as a bar of soap with an embedded loop of rope. While the present invention is intended to be used in conjunction with a conventional towel bar, the present invention will also have other utility that will be apparent to a user.

The preferred embodiment of the present invention uses two identical vertical brackets of uniform thickness that are pierced by through-openings slidably mating with multiple horizontal rods of uniform cross-section such that the distance that the brackets are spaced apart may be adjusted. Most often, the distance between the outside edges of the brackets is adjusted to be slightly less than W, the inside distance of the associated conventional towel bar, so that the resultant shelf may be snugly placed on the conventional towel bar. While the inside distance W of a conventional towel bar is typically 14 inches (365 mm), variations are known and may be accommodated by the present invention.

The side appearance of a preferred bracket resembles the capital Greek letter gamma with a vertical back that conforms to the wall, a top that is pierced by multiple rods lying in a horizontal plane, a bottom pierced by at least one rod that is spaced from the wall, and a front that extends downward from a point in front of the towel bar (A) to a point that is behind the towel bar and closer to the wall (B). The inside distance between the wall and the surface of the towel bar proper that is closest to the wall is referred to as N. As mounted on a conventional towel bar, the backward and downward sloping front of each shelf bracket rests on the towel bar proper at a point somewhat farther from the wall than N and above the center of the towel bar proper. A and B are selected so that a range of Ns may be automatically accommodated. A preferred bracket is also pierced by lightening holes that advantageously have triangular or trapezoidal edges and a preferred bracket has a hook at the front of its bottom.

The rods of the preferred embodiment of the present invention have an essentially uniform cross-section preferably either in the shape of circles, ovals or rectangles. The expected lengths of the rods of the preferred embodiment are close to W. The use of rods composed of an essentially transparent lucite and having a circular cross-section has been found particularly appropriate. The preferred embodiment uses five top rods. While not part of the preferred embodiment, the invention encompasses one or more rods protruding past the outside edge of one or more of the brackets.

The essentially horizontal surface formed by the top rods, supported by the brackets, implements a porus shelf that includes among its attributes a minimizing of mass as compared to a solid shelf and an open structure that does not encourage overloading. The position of the bottom rod nearly under the associated conventional towel rod, and the extent and position of the vertical backs of the brackets that conform to the wall, result in forces that increase the stability of the assembly when a towel (or the like) is placed on the bottom rod.

Alternate embodiments may be formed using more than two brackets resulting in a shelf that has enhanced stiffness, brackets of other than uniform thickness, brackets with different but equivalent shapes, rods of various colors and compositions, rods having only end portions that mate with associated socket openings in the brackets, rods shorter than W or longer than W, and other variations that will be apparent to one skilled in the art.

The shelf is mounted by looping its bottom over the towel bar and lowering the shelf onto the towel bar. The inherent ease of mounting and demounting the shelf, and its inherently light weight, recommends its use by individuals (such as travelers and those in the military) who use communal bathrooms.

DETAILED DESCRIPTION OF THE INVENTION AND ITS PREFERRED EMBODIMENT

Figure 1:
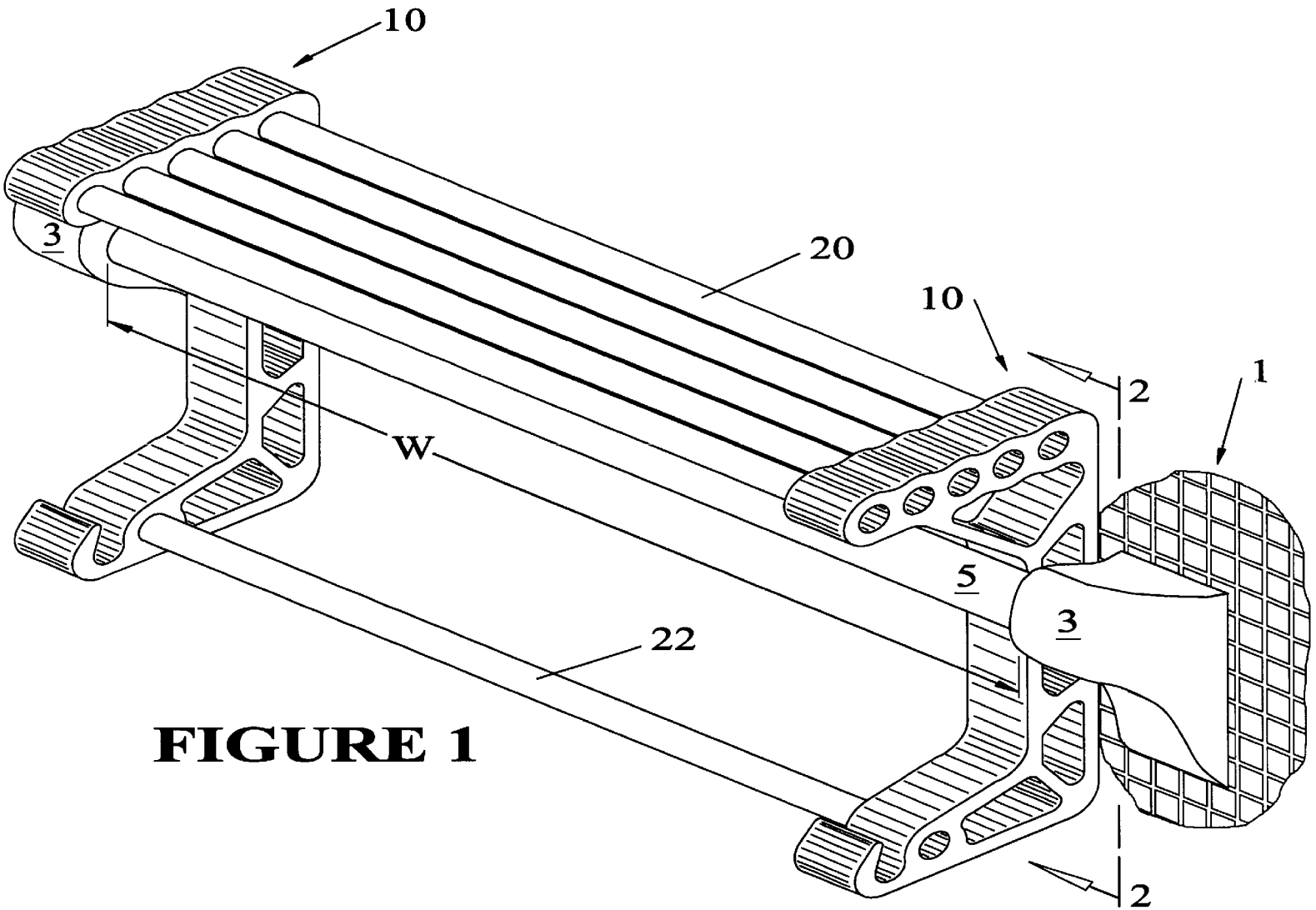
FIG. 1 is a perspective view of the shelf coupled to a conventional towel bar.
Figure 2:
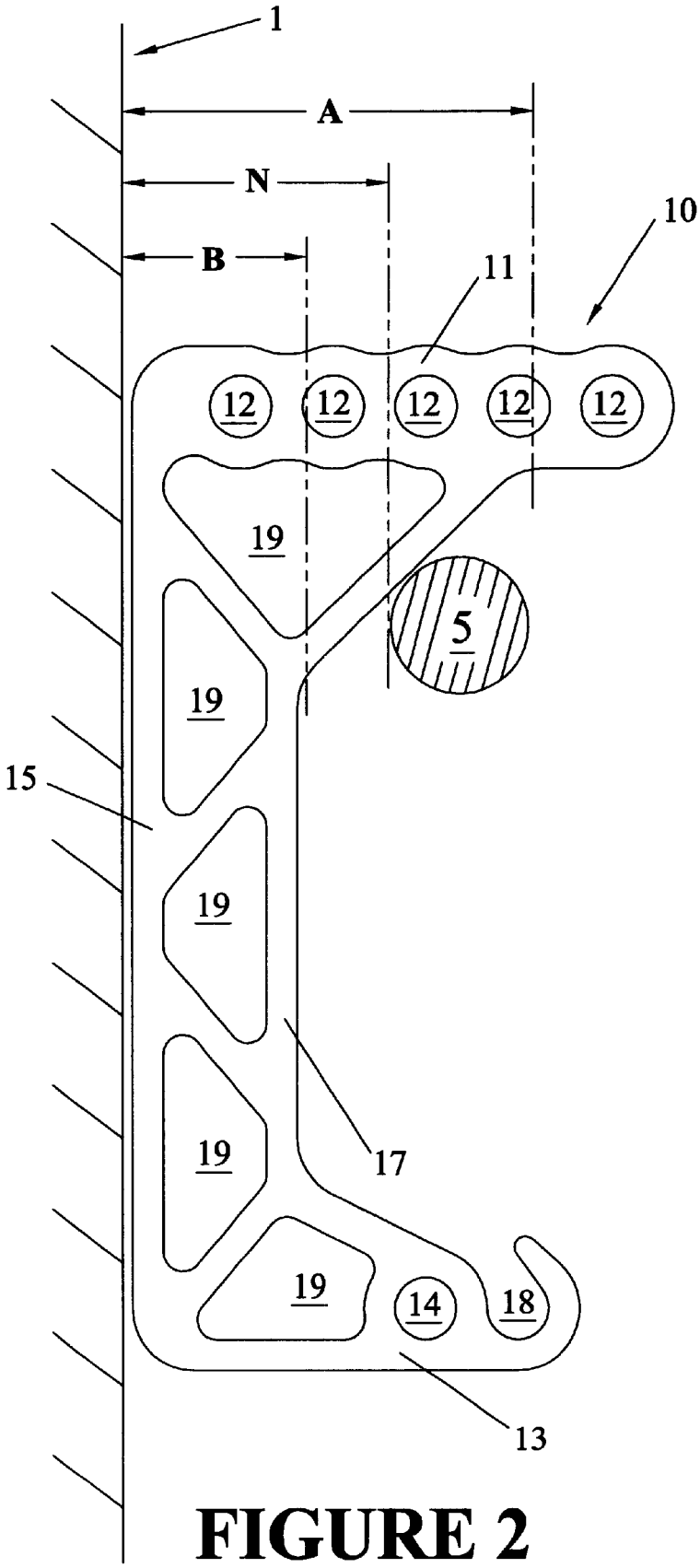
FIG. 2 is a cross section view through one of the brackets of the shelf when it is coupled to a conventional towel bar and shows the relative position of the wall, shelf, and towel bar's rod.

FIG. 1 shows the preferred embodiment of the present invention mounted on an existing, conventional, wall affixed towel bar (consisting of towel-bar brackets 3 and towel-bar rod 5) using only friction and gravitationally induced forces. FIG. 2 is a cross section through one of the brackets 10 as shown on FIG. 1.

A typical, conventional, wall affixed towel bar has a single towel-bar rod 5 (FIG. 1) placed between two towel-bar brackets 3 (FIG. 1) that are affixed to wall 1 (FIG. 2). The inside distance seen on FIG. 2 between wall 1 and the surface of the towel-bar rod 5 that is closest to wall 1 is herein referred to as N and is typically 1.5 inches (38 mm). The inside distance seen on FIG. 1 between towel-bar brackets 3 is herein referred to as W and is typically 14 inches (356 mm).

The present invention may generally be seen in FIG. 1 to be described as a series of rods (top rods and bottom rod 22) supported by brackets 10 that are mounted between towel-bar brackets 3. As mounted, top rods 20 are in an essentially horizontal plane forming a porous horizontal surface and bottom rod 22 provides a substitute for the conventional towel-bar rod 5, which is occluded by the mounted shelf.

The preferred brackets 10 of the present invention may generally be seen in FIG. 2 to be described as having a side appearance that resembles the capital Greek letter gamma with a vertical bracket-back 15 that conforms to the wall, a bracket-top 11 that is pierced by multiple top through-openings 12 lying essentially in a horizontal plane, a bracket-bottom 13 pierced by at least one bottom through-opening 14 that is spaced from wall 1 and that is nominally under towel-bar rod 5, and a bracket-front 17 that extends downward from a point in front of the towel-bar rod 5 (distance A from wall 1) to a point that is behind the towel-bar rod 5 and closer to wall 1 than A (distance B from wall 1) and thence downward to bracket-bottom 13. As mounted on a conventional towel bar, the backward and downward sloping bracket-front 17 of each bracket 10 rests on towel-bar rod 5 at a point somewhat farther from wall 1 than N and above the center of towel-bar rod 5. A and B are selected so that a range of Ns may be automatically accommodated. A preferred bracket 10 is also pierced by lighting-holes 19 that advantageously have triangular or trapezoidal edges and is provided with bracket-hook 18 at the forward edge of bracket-bottom 13.

Top rods 20 and bottom rod 22 of the preferred embodiment of the present invention have an essentially uniform cross-section, preferably either in the shape of circles, ovals or rectangles, that mates with top through-openings 12 and bottom through-opening 14 (seen on FIG. 2). The mating of the rods to the through-openings is such that the rods may, with some urging, slide through the through-openings to effect different spacings between brackets 10. The expected lengths of the rods of the preferred embodiment are at least close to W. The use of rods composed of an essentially transparent lucite and having a circular cross-section has been found particularly appropriate. In an alternative embodiment, only the ends of the rods have a shape that mates with top openings 12 in the form of sockets and bottom opening 14 in the form of a socket. In an alternative embodiment, the cross-sections of the rods are not all the same.

In the preferred embodiment, seen in FIG. 1, the rods have a diameter of about 0.5 inches (13 mm), there are five top rods 20, and the vertical spacing between the centers of top rods 20 and the center of bottom rod 22 (and thus the vertical length of bracket-back 15) (FIG. 2) is about seven inches (178 mm). Advantageously, no more than six top rods 20 are used. Advantageously, the vertical length of bracket-back 15 (FIG. 2) is at least five inches (127 mm). In the preferred embodiment, bottom rod 22 is about N distant from the vertical edge of bracket-back 15 (FIG. 2). This means that the centroid of bottom rod 22 is within one inch (25 mm) of being N distant from the vertical edge of bracket-back 15 (FIG. 2).

The nature of the present invention is such that it could advantageously be packaged in a disassembled state including brackets 10, top rods 20, and bottom rod 22. Such a combination could be assembled into the present invention by placing the near end of each rod within each through-opening of a bracket 10 and then placing the far end of each rod within each corresponding through-opening of a second bracket 10. The brackets 10 may be slid towards each other if it is desired to have them closer together.

Figure 3:
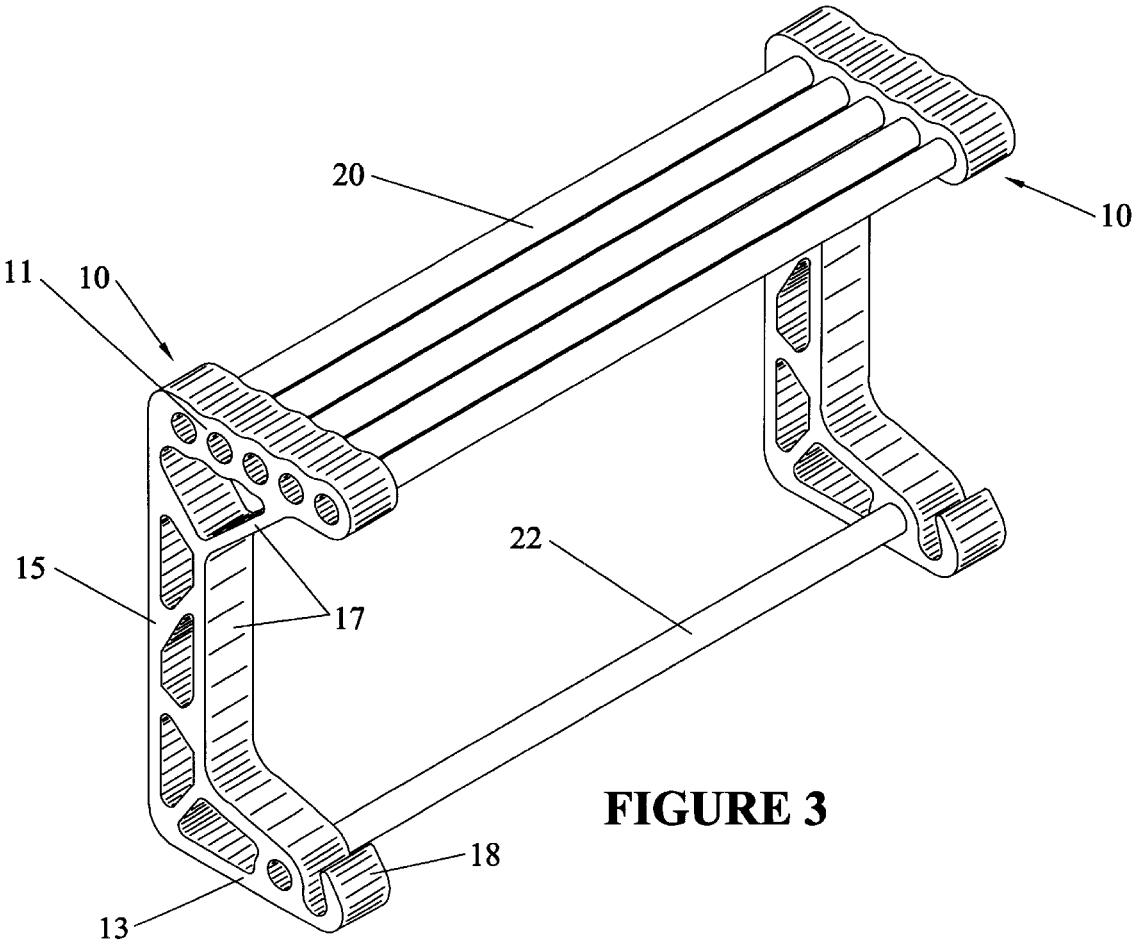
FIG. 3 is a perspective view of just the shelf.

The assembled present invention (as shown on FIG. 3) is mounted to a conventional towel bar by looping each bracket-bottom 13 (FIG. 2) over the top of towel-bar rod 5 (FIG. 1), rotating the assembly so that bracket-back 15 (FIG. 2) is flush with wall 1 (FIG. 2), and lowering the assembly until bracket-front 17 (FIG. 2) comes to rest on towel-bar rod 5 (FIG. 1). Demounting is effected by reversing the steps. No object other than the shelf itself is involved with its mounting and demounting.

Though desirable, lighting-holes 19 and bracket-hook 18 are optional. More than two brackets may be used resulting in a shelf that has enhanced stiffness. Brackets having different but equivalent shapes from those shown may be used. Rods of various colors, compositions, and lengths (including shorter than W or longer than W) may be used.

The preferred embodiment and alternate embodiments of the present invention have been described in detail. The embodiments described are illustrative and not restrictive.

I claim:

1. A portable shelf for mounting on a wall affixed towel bar of width W that is spaced a distance N from the wall, comprising:

a plurality of rods each having an essentially uniform cross-section;

a plurality of brackets each having a top, back, bottom and front where said top has a plurality of through-openings that are aligned horizontally and that have a cross-section that is essentially the same as said rod's cross-section, said back has a vertical edge, said bottom has at least one through-opening that has a cross-section that is essentially the same as said rod's cross-section, and said front extends downward from a point that is more than N distant from said back's vertical edge to a point that is less than N distant from said back's vertical edge; and said rods and said brackets are connected by sliding each of said rods within each similar one of said through-openings such that the outermost of said brackets are spaced less than W, whereby a shelf that can be supported by the towel bar and the wall is effected.

2. A shelf as claimed in claim 1, wherein one of said at least one through-opening in said bottom of said brackets is about N distant from said back's vertical edge.

3. A shelf as claimed in claim 1, wherein said bottom of at least one of said brackets further includes hook means for holding items.

4. A shelf as claimed in claim 1, wherein said brackets are pierced by lightning holes.

5. A shelf as claimed in claim 1, wherein the shape of said essentially uniform cross-section of said rods is selected from the group consisting of circles, ovals, and rectangles.

6. A shelf as claimed in claim 1, wherein the length of said back's vertical edge is at least five inches.

7. A portable shelf for mounting on a wall affixed towel bar of width W that is spaced a distance N from the wall, comprising:

two brackets each having a top, back, bottom and front where said top has a plurality of top sockets that are aligned horizontally, said back has a vertical edge, said bottom has at least one bottom socket, and said front extends downward from a point that is more than N distant from said back's vertical edge to a point that is less than N distant from said back's vertical edge;

a plurality of top rods each with a length of about W and each having ends mated with each similar one of said top sockets; and at least one bottom rod with a length of about W and having ends mated with each of said bottom sockets, whereby said brackets are spaced about W apart and a shelf that can be supported by the towel bar and the wall is effected.

8. A shelf as claimed in claim 7, wherein one of said bottom sockets in each of said brackets is about N distant from said back's vertical edge.

9. A shelf as claimed in claim 7, wherein said bottom of at least one of said brackets further includes hook means for holding items.

10. A shelf as claimed in claim 7, wherein said brackets are pierced by lightning holes.

11. A shelf as claimed in claim 7, wherein said top of each of said brackets has no more than six top sockets each mated with one of said top rods.

12. A shelf as claimed in claim 7, wherein the length of said back's vertical edge is at least five inches.

13. A portable shelf for mounting on a wall affixed towel bar that is spaced a distance N from the wall, comprising:

two brackets each having a top, back, bottom and front where said top has a plurality of top through-openings that are aligned horizontally, said back has a vertical edge, said bottom has at least one bottom through-opening, and said front extends downward from a point that is more than N distant from said back's vertical edge to a point that is less than N distant from said back's vertical edge;

a plurality of top rods each having an essentially uniform cross-section slidably fitting within each similar one of said top through-openings in each of said brackets forming a porous horizontal surface; and at least one bottom rod having an essentially uniform cross-section slidably fitting within each similar one of said bottom through-openings in each of said brackets, whereby the spacing between said brackets can be adjusted and a shelf that can be supported by the towel bar and the wall is effected.

14. A shelf as claimed in claim 13, wherein one of said at least one through-opening in said bottom of said brackets is about N distant from said back's vertical edge.

15. A shelf as claimed in claim 13, wherein said bottom of at least one of said brackets further includes hook mead for holding items.

16. A shelf as claimed in claim 13, wherein said brackets are pierced by lightning holes.

17. A shelf as claimed in claim 13, wherein the shape of said essentially uniform cross-section of said rods is selected from the group consisting of circles, ovals, and rectangles.

18. A shelf as claimed in claim 13, wherein said top of each of said brackets has more than six top through-openings each mated with one of said top rods.

19. A shelf as claimed in claim 13, wherein the length of said back's vertical edge is at least five inches.

* * * * *